US011673630B2

(12) United States Patent
Weisenburger

(10) Patent No.: US 11,673,630 B2
(45) Date of Patent: Jun. 13, 2023

(54) INFLATABLE SURFBOARD HAVING A DRIVE UNIT

(71) Applicant: WBV Weisenburger Bau+Verwaltung GMBH, Rastatt (DE)

(72) Inventor: Nicolai Weisenburger, Baden-Baden (DE)

(73) Assignee: WBV Weisenburger Bau+Verwaltung GmbH, Rastatt (DE)

( * ) Notice: Subject to any disclaimer, the term of this patent is extended or adjusted under 35 U.S.C. 154(b) by 7 days.

(21) Appl. No.: 16/956,561

(22) PCT Filed: Dec. 21, 2018

(86) PCT No.: PCT/EP2018/086553
§ 371 (c)(1),
(2) Date: Jun. 20, 2020

(87) PCT Pub. No.: WO2019/122321
PCT Pub. Date: Jun. 27, 2019

(65) Prior Publication Data

US 2021/0147042 A1 May 20, 2021

(30) Foreign Application Priority Data

Dec. 21, 2017 (DE) ..... 10 2017 130 955.1

(51) Int. Cl.
*B63B 32/51* (2020.01)
*B63B 32/10* (2020.01)

(52) U.S. Cl.
CPC ..... *B63B 32/51* (2020.02); *B63B 32/10* (2020.02); *B63B 2221/16* (2013.01)

(58) Field of Classification Search
CPC ..... B63B 32/10; B63B 32/51; B63B 2221/16; B63B 2221/20; B63B 2221/22
See application file for complete search history.

(56) References Cited

U.S. PATENT DOCUMENTS 3,659,546 A * 5/1972 Miklos ..... B63B 35/34 114/246
4,694,770 A * 9/1987 Kitner ..... B63B 34/10 114/123
4,811,682 A 3/1989 Hwang et al.
5,184,564 A * 2/1993 Robbins ..... B63B 7/082 114/345
5,282,437 A * 2/1994 Avillez de Basto .... B63B 7/082 114/345

(Continued)

FOREIGN PATENT DOCUMENTS

CN 202541788 U 11/2012
CN 205675195 U * 11/2016

(Continued)

*Primary Examiner* — Ajay Vasudeva
(74) *Attorney, Agent, or Firm* — Bay State IP, LLC

(57) ABSTRACT

The invention relates to an inflatable surfboard with an inflatable hull component with two lateral arms (7*a*, 7*b*) which form a receptacle, and drive unit (6) which forms an outer contour which fits into the receptacle in a positively locking manner, and at least one fastening means (23, 23*a*, 23*b*, 24*a*, 24*b*, 26*a*, 26*b*, 27, 27*a*, 27*b*, 28, 61*a*, 61*b*) at the stern end of the surfboard (1), wherein the at least one fastening means (23, 23*a*, 23*b*, 24*a*, 24*b*, 26*a*, 26*b*, 27, 27*a*, 27*b*, 28, 61*a*, 61*b*) is inelastic.

4 Claims, 17 Drawing Sheets

(56) References Cited

U.S. PATENT DOCUMENTS

Figure 1:
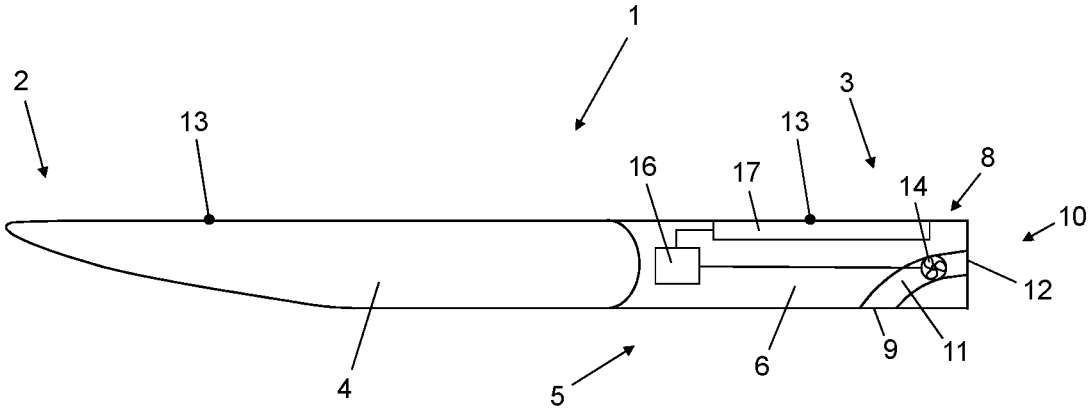

| | | | | | |
|---|---|---|---|---|---|
| 6,135,047 | A * | 10/2000 | Miller | B63B 29/04 | 114/343 |
| 8,230,800 | B1 * | 7/2012 | Wing | B63B 43/14 | 114/123 |
| 10,526,057 | B2 * | 1/2020 | Kohnsen | B63B 32/40 | |
| 2001/0032578 | A1 * | 10/2001 | Mcauliffe | B63B 59/02 | 114/345 |
| 2008/0236467 | A1 | 10/2008 | Wyman | | |

FOREIGN PATENT DOCUMENTS

| | | | | | |
|---|---|---|---|---|---|
| CN | 205675195 | U | | 11/2016 | |
| DE | 2155978 | A1 | | 5/1973 | |
| DE | 102015108863 | A1 | | 12/2016 | |
| JP | 2003026085 | A | | 1/2003 | |
| JP | 3181551 | U | * | 2/2013 | |
| KR | 102387698 | B1 | * | 4/2022 | B63B 32/51 |
| KR | 20220080234 | A | * | 6/2022 | B63B 32/51 |

* cited by examiner

INFLATABLE SURFBOARD HAVING A DRIVE UNIT

CROSS REFERENCE TO RELATED APPLICATION

This application is for entry into the U.S. National Phase under § 371 for International Application No. PCT/EP2018/086553 having an international filing date of Dec. 21, 2018, and from which priority is claimed under all applicable sections of Title 35 of the United States Code including, but not limited to, Sections 120, 363, and 365(c) and which in turn claims priority under 35 USC 119 to German Patent Application No. 102017130955.1 filed on Dec. 21, 2017.

The invention relates to an inflatable surfboard with a drive unit.

Surfboards are well known in the prior art for example from DE 10 2015 103 503.0. The known surfboard has an inflatable hull component with a rear recess as well as a drive unit which fits into the rear recess in a positively locking manner and is inserted therein. However, one problem with the known surfboard is that the drive unit can slide out of the recess at the rear.

DE 10 2015 108 863 A1 discloses fastening means in the form of rubber bands which, however, do not exert sufficient lateral force on the drive unit which is used.

In U.S. Pat. No. 4,811,682 B a child's boat is disclosed which has a peripheral inflatable rubber hose. A seat part is fastened to the peripheral hose by means of bands. The child's boat is not suitable for carrying on dynamic surfing sport.

It is an object of the present invention to provide an inflatable surfboard which avoids or at least reduces the above-mentioned disadvantages.

This object is achieved by an inflatable surfboard referred to in the introduction with the features of claim 1.

The inflatable surfboard has an inflatable hull component with two lateral arms, which form a receptacle, and a drive unit which has an outer contour which at least in some sections fits into the receptacle in a positively locking manner. At least one fastening means is provided at the stern end of the surfboard. The at least one fastening means is inelastic.

The inflatable hull component is preferably manufactured from a drop stitch material and is inflated at high pressure by means of a compressor, an air pump or the like. The hull component has two lateral arms at its stern end so that at the stern end a recess is produced which is approximately U-shaped when viewed from above and forms a receptacle for a drive unit. The outer contour, i.e. the lateral wall of the drive unit, is adapted to the contour of the lateral inner wall of the inflated receptacle, so that a substantially positively engaged connection takes place when the drive unit is inserted into the receptacle.

The inner wall of the receptacle of the inflatable hull component is advantageously curved outwards, that is to say it is convex. The lateral wall running round the drive unit in a U shape is correspondingly concave. This configuration prevents the drive unit from sliding out upwards towards the deck or downwards towards the underwater surface.

It has been shown that rubber bands provided at the stern end are not sufficient in order to reliably prevent the drive unit from sliding out of the receptacle. It has been shown that inelastic fastening means are significantly more advantageous and reliably prevent the drive unit from sliding out.

The at least one fastening means is configured as at least one belt. The belt is not elastic. The belt may be in one piece or in two pieces, and also two or more belts may be chosen which are each formed in two pieces. The belt is fastened to the two lateral arms and extends along the drive unit at the stern end, and the at least one belt can be tensioned by means of at least one lever mechanism.

In a one-piece belt two belt ends are arranged laterally on the arms in a fixed position, i.e. are glued or sewn there or fastened there in some other way. The belt preferably then runs along the stern part of the drive unit in the inflated state and prevents it from sliding out. The belt can also be configured in two parts in belt sections and can have a closure which connects both belt sections to one another by means of a lever mechanism, a ratchet or the like. This can have the advantage over the one-piece belt that the drive unit can also be inserted into the inflated surfboard from the rear, whereas in the one-piece belt initially some air must be released from the hull component in order to be able to insert or release the drive unit. In both cases tensioning of the belt takes place by the inflation of the surfboard at high pressure.

In another embodiment two belts are provided at the stern end, which each have two belt sections which can each be connected to one another by means of a closure for example in the form of a lever mechanism, i.e. in the form of an eyelet and a lever closure, a toggle lever or a ratchet, or by means of a ratchet or similar devices. In this case each of the belts can have a belt section which is fastened laterally on an arm or on a stern end of the arm, and an associated corresponding belt section which is fastened laterally adjacent to the nozzle at the stern end of the drive unit. The same construction can also be provided on the other arm of the hull component. The possibility now exists of arranging the eyelet on one belt section and the closure on the corresponding belt section or vice versa. The same applies to the belt on the other arm.

In a further embodiment of the invention no separate belt is provided, but the lateral arms extend in a hook shape behind the drive unit and engage behind the drive unit so that it is prevented from sliding out. The arms extend laterally along the drive unit, and at the stern end they extend inwards in a hook shape. In this embodiment initially the drive unit is placed into the hull component which is not inflated or only partially inflated. Then the hull component becomes taut and is inflated with a compressor or an air pump, and the positively engaged connection between the concave or convex configuration of the lateral wall the drive unit is prevented from sliding out upwards or downwards. The hook-shaped configuration of the arms will also prevent the drive unit from sliding out of the surfboard at the stern end.

This embodiment is preferred because due to the hooks the fastening means are an integral component of the arms. Separate fastening means are omitted. It is also possible to combine this embodiment with an additional fastening means according to the other embodiments.

Figure 2A:
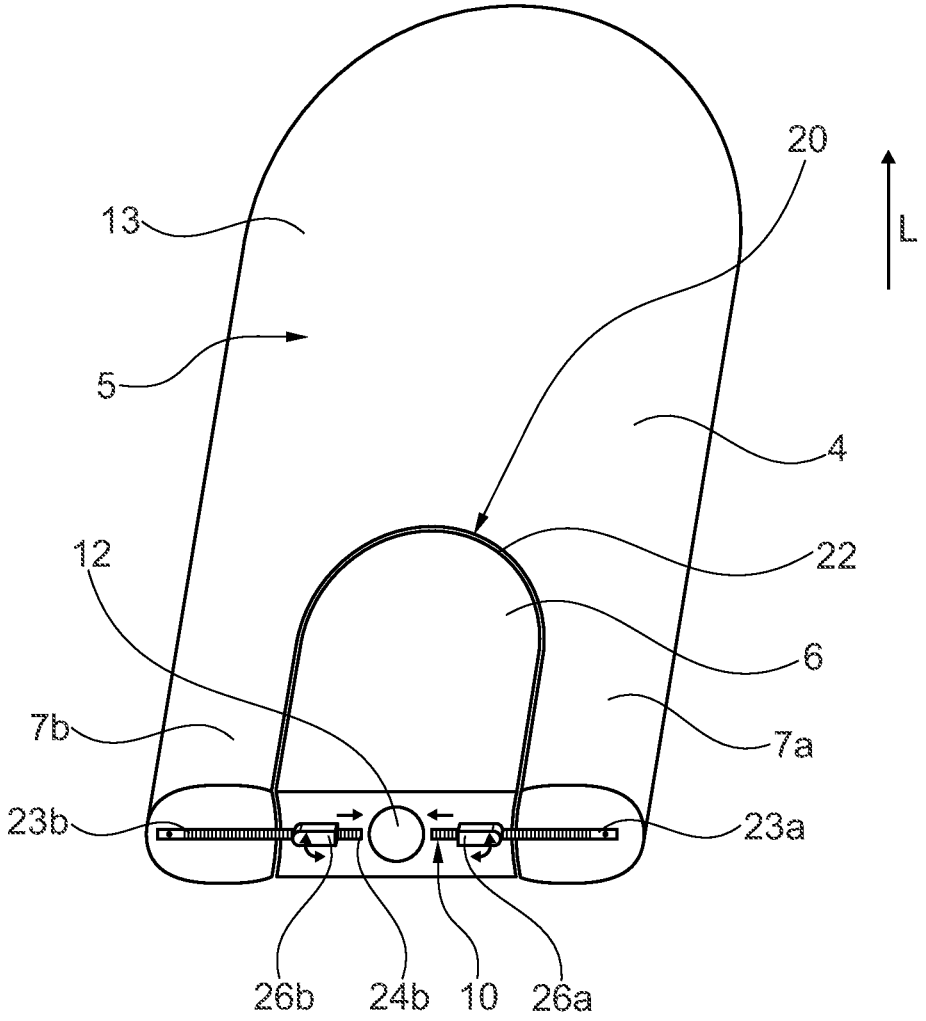
Figure 2B:
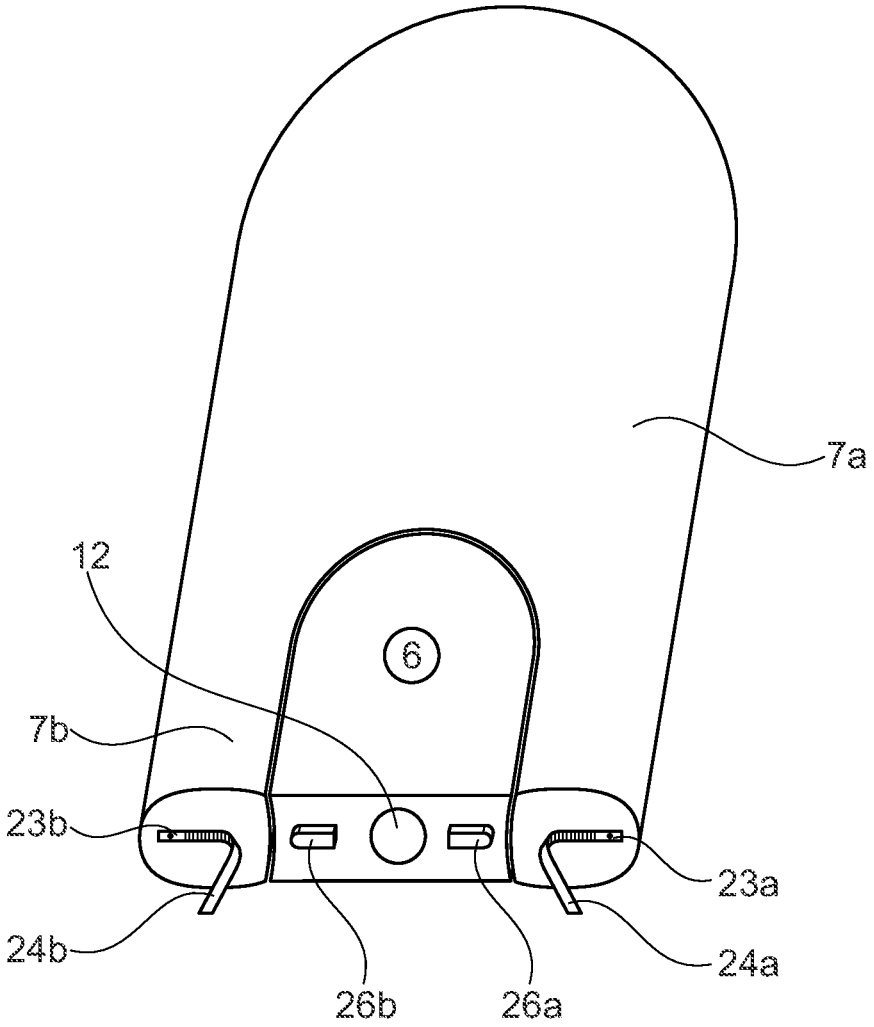
Figure 2C:
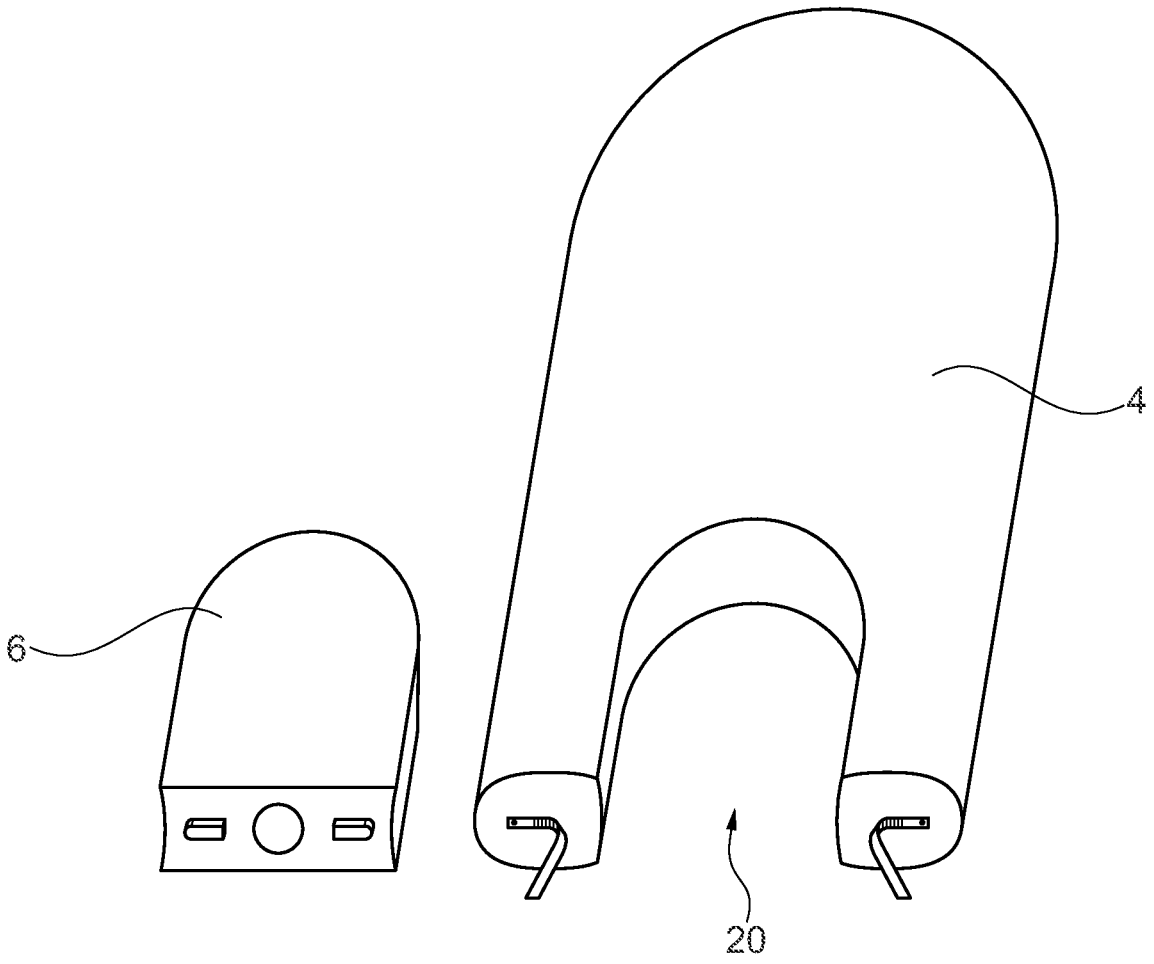
Figure 2D:
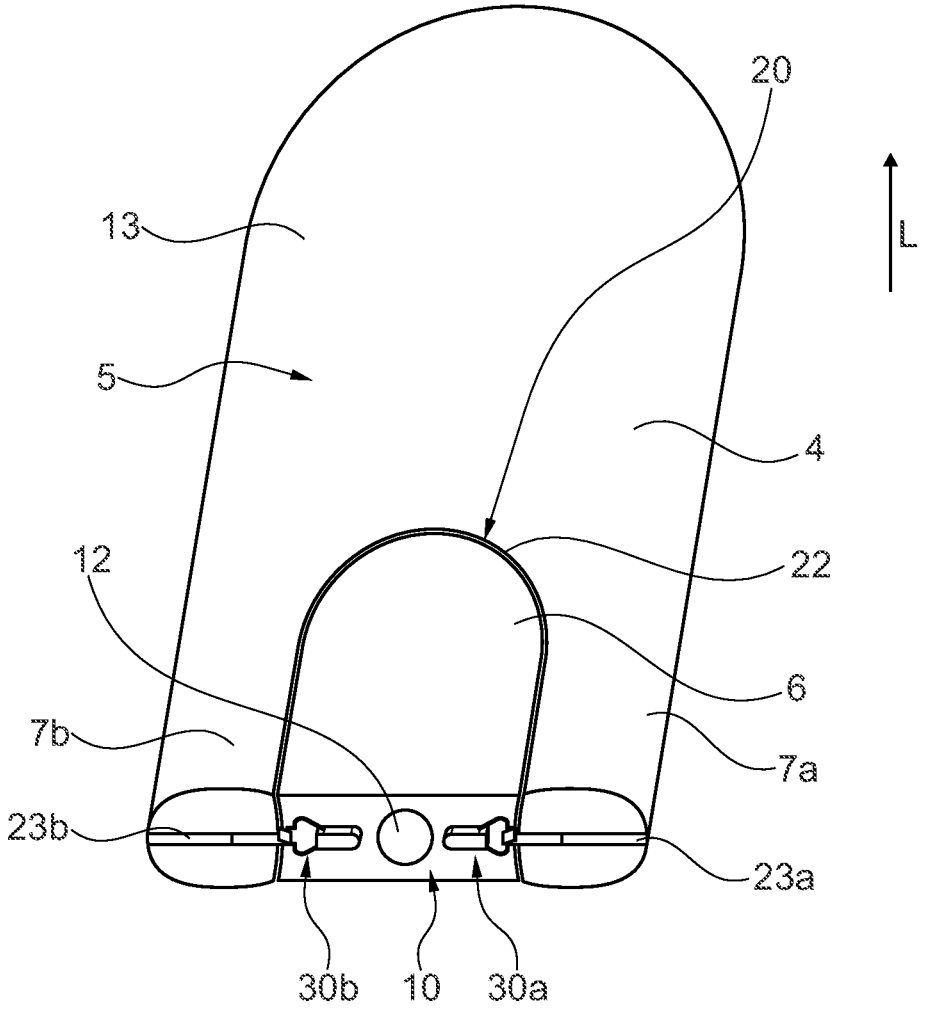

The invention is described with reference to five embodiments with 13 drawings. In the drawings:

FIG. 1 shows a lateral sectional view of a surfboard according to the invention, FIG. 2*a* shows a rear view of a first embodiment of a fastening mechanism with two closed fastening belts at the stern end, FIG. 2*b* shows a rear view of the first embodiment with two open fastening belts at the stern end, FIG. 2*c* shows a rear view of the first embodiment with two open fastening belts at the stern end with the drive unit removed, FIG. 2*d* shows a rear view of a lever mechanism configured as a toggle lever.

Figure 2E:
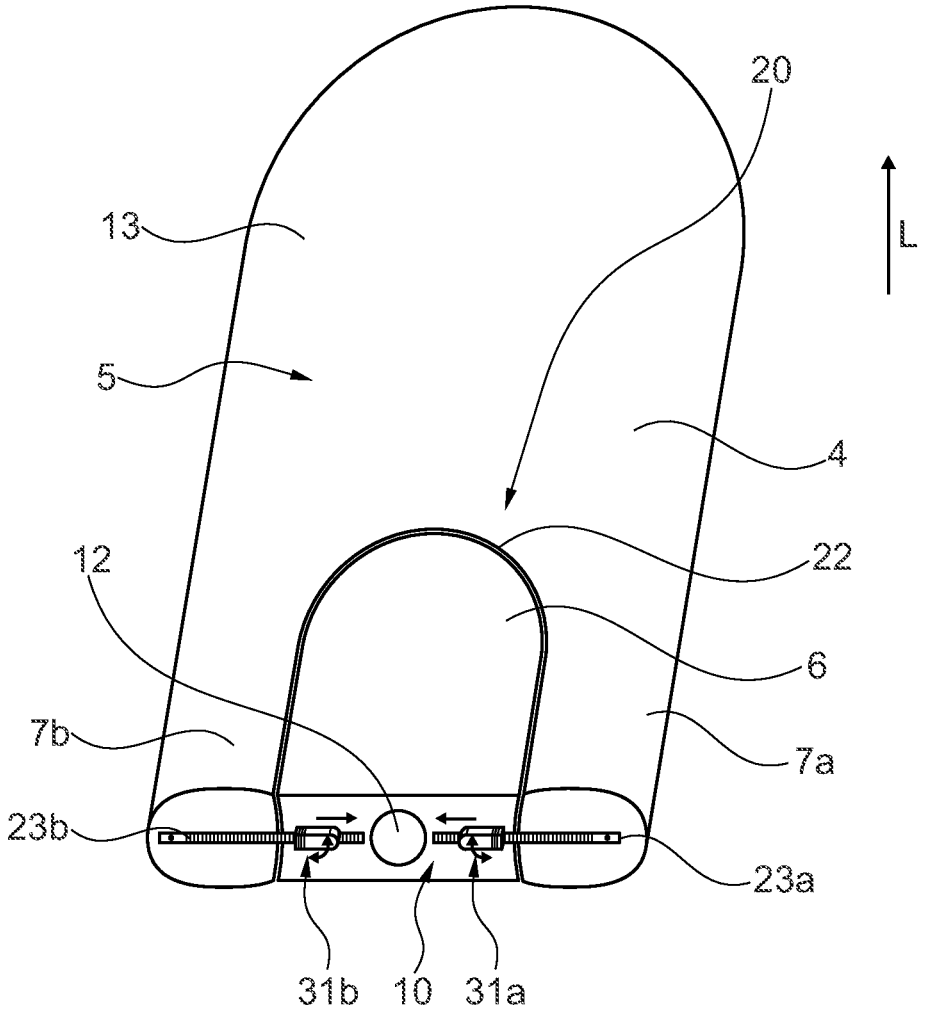

FIG. 2*e* shows a rear view of a lever mechanism configured as a ratchet.

Figure 2F:
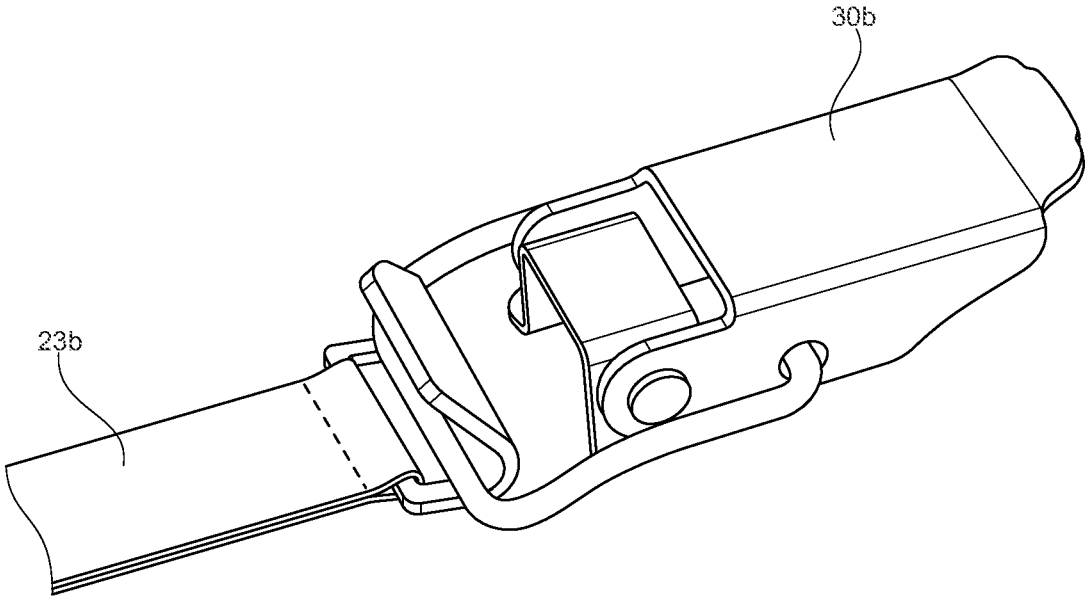

FIG. 2*f* shows a perspective view of the toggle.

Figure 3A:
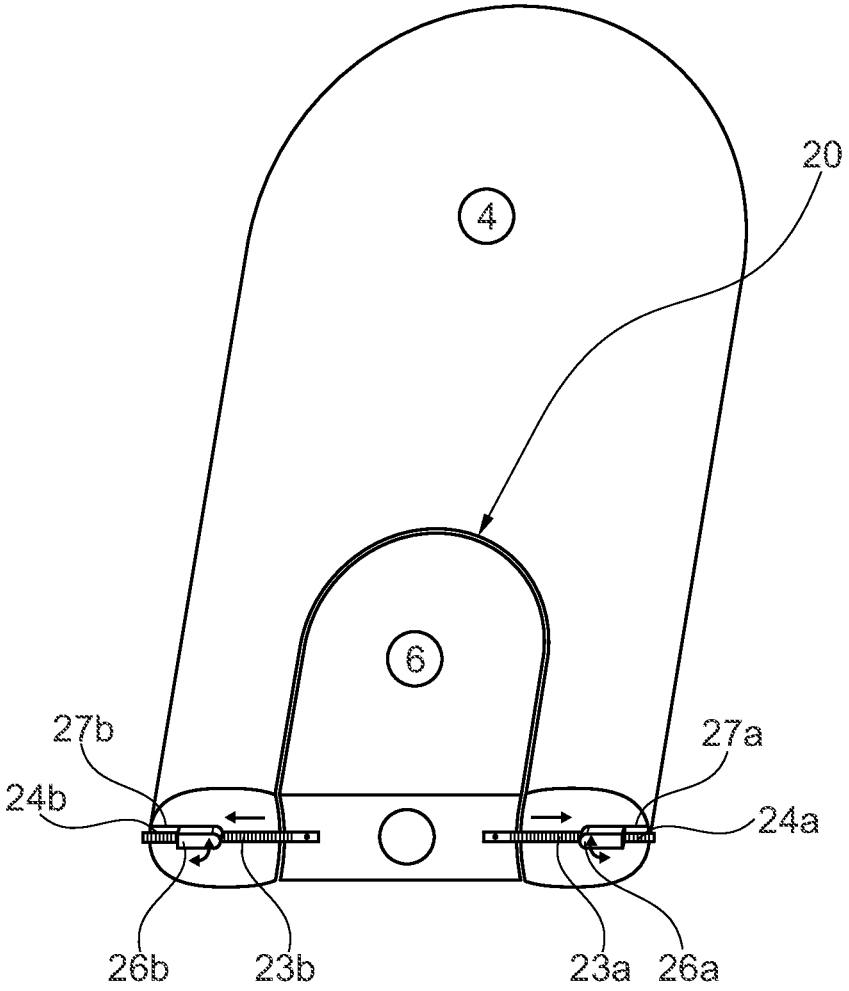
Figure 3B:
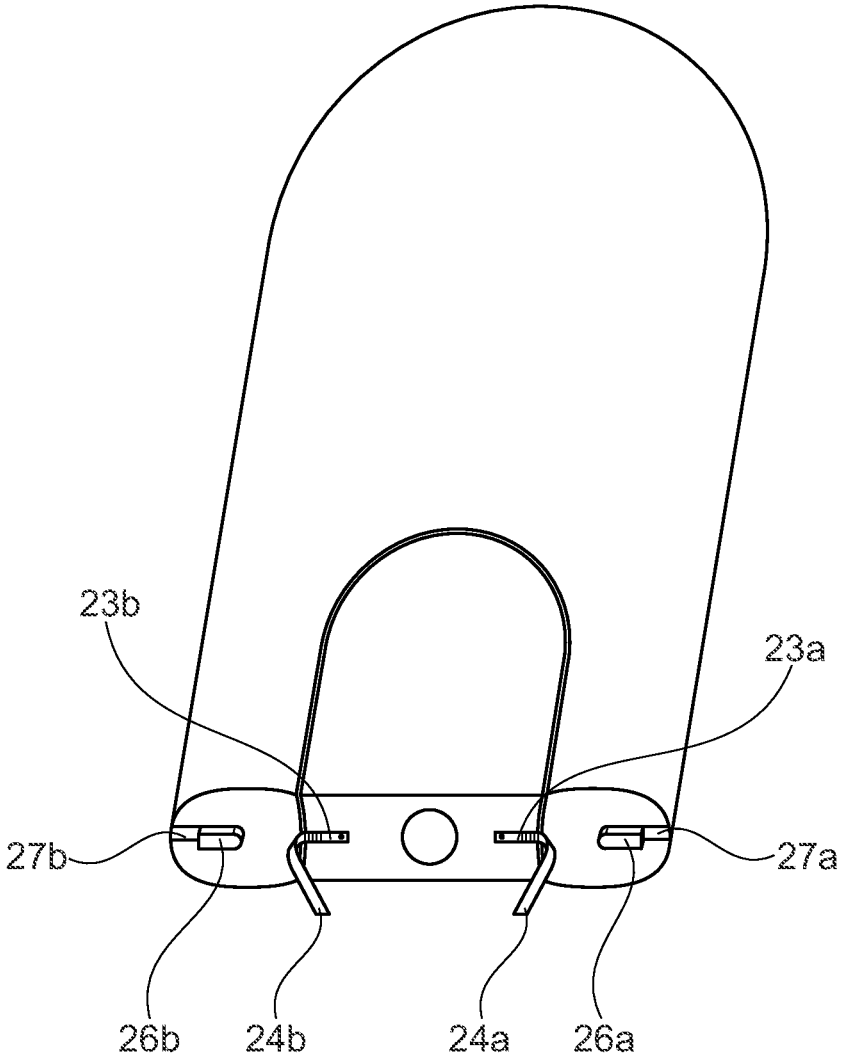
Figure 3C:
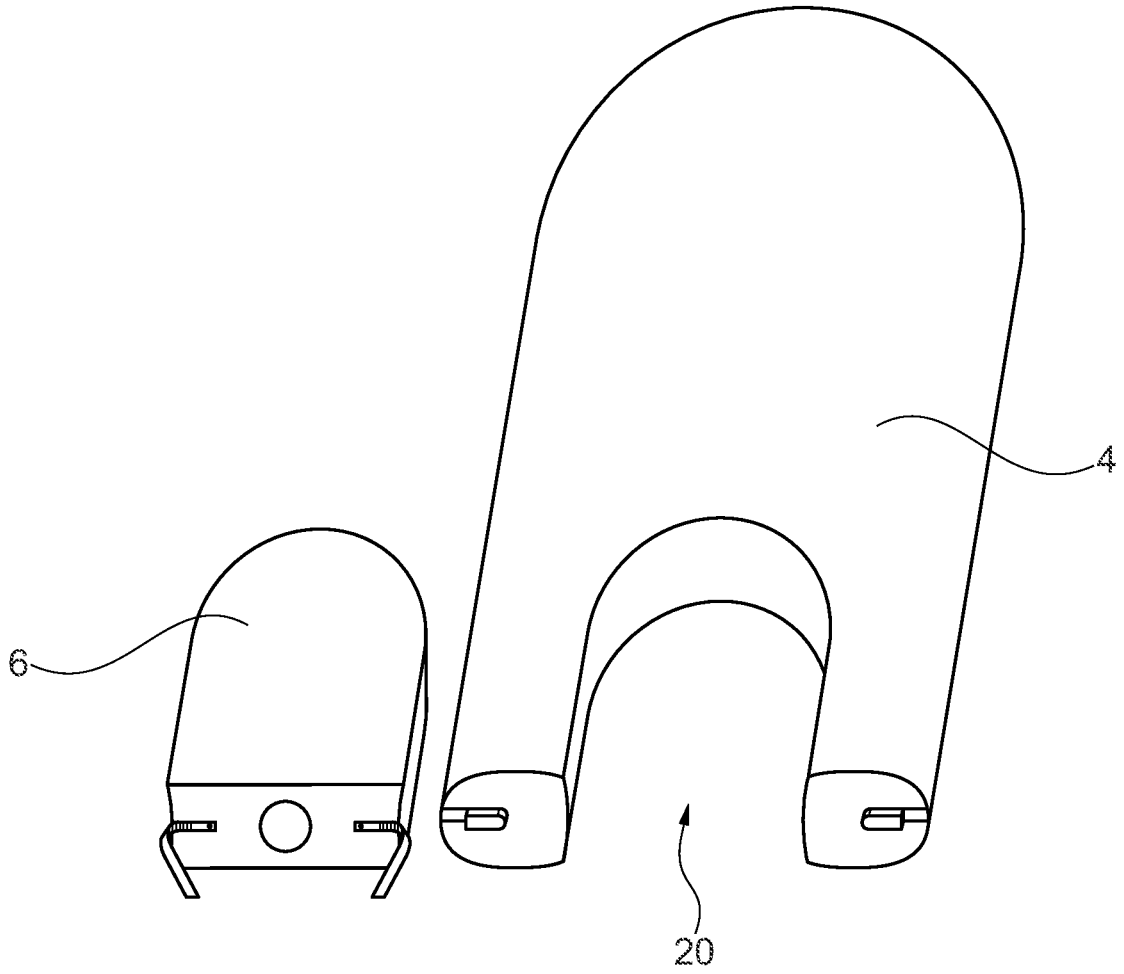
Figure 3D:
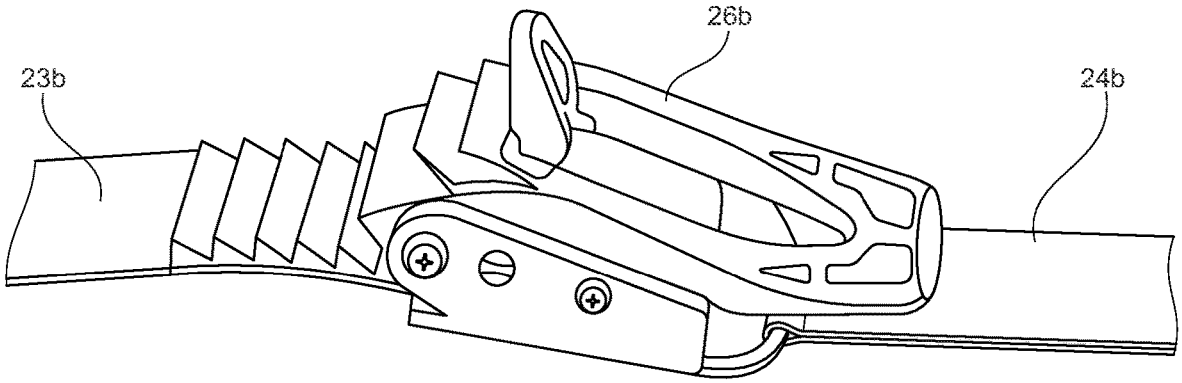

FIG. 3*a* shows a rear view of a second embodiment of a fastening mechanism with two closed fastening belts at the stern end, FIG. 3*b* shows a rear view of the second embodiment with two open fastening belts at the stern end, FIG. 3*c* shows a rear view of the second embodiment with two open fastening belts at the stern end with the drive unit removed, FIG. 3*d* shows a perspective view of the ratchet.

Figure 4A:
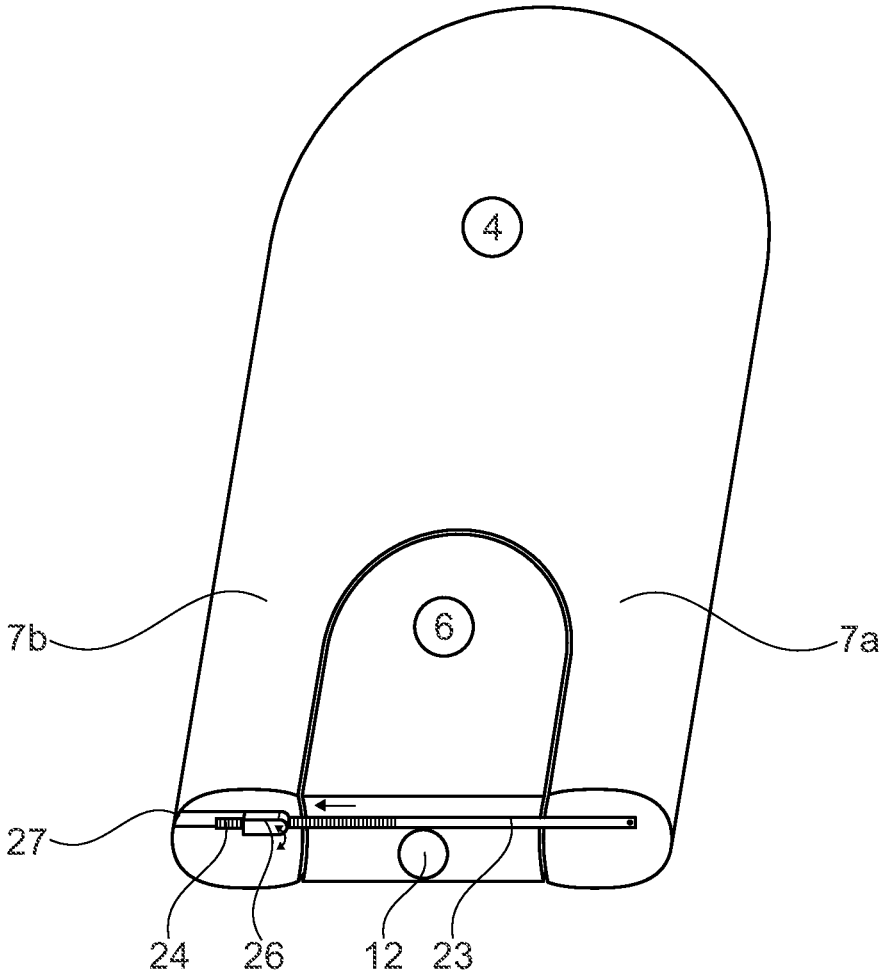
Figure 4B:
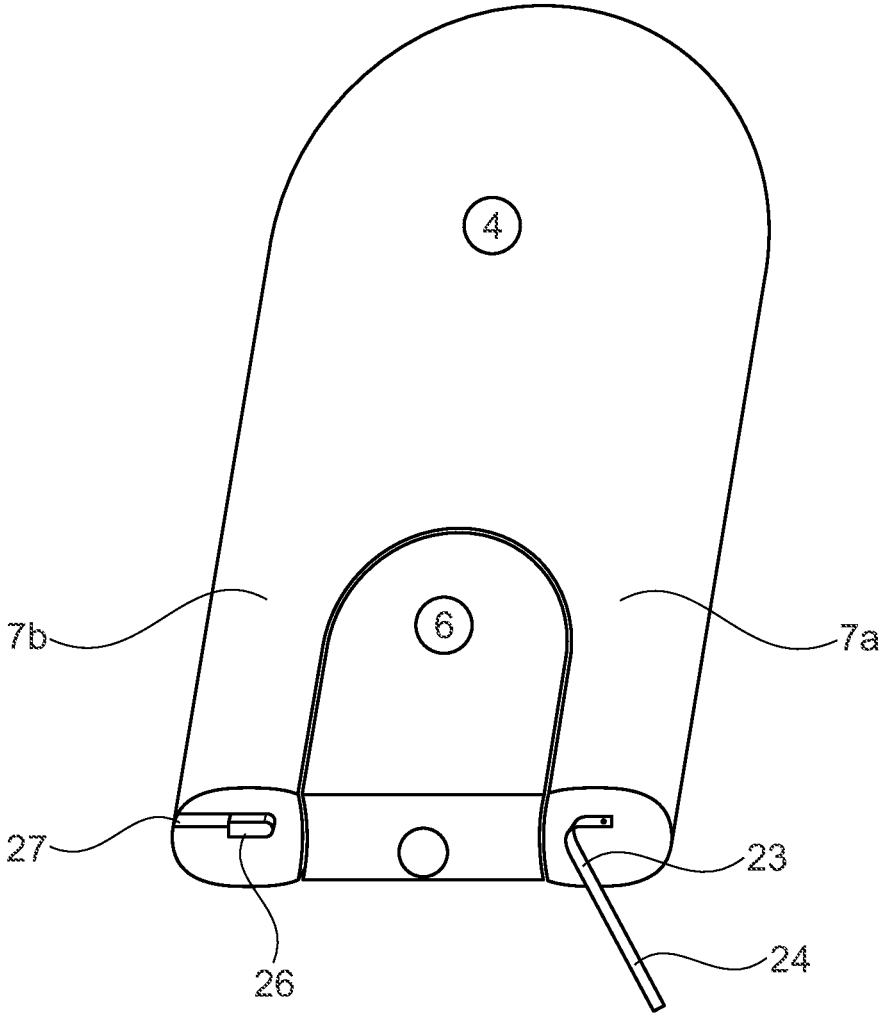
Figure 4C:
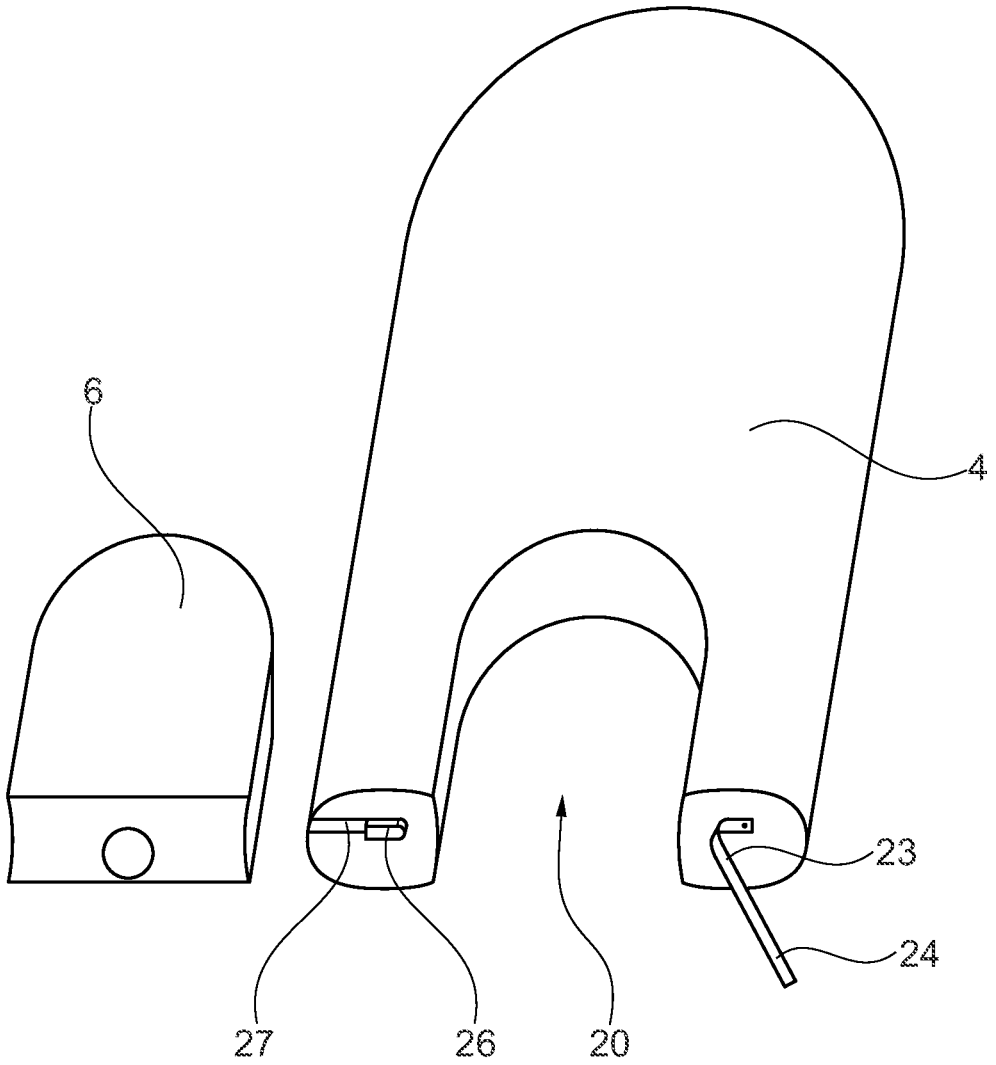
Figure 5A:
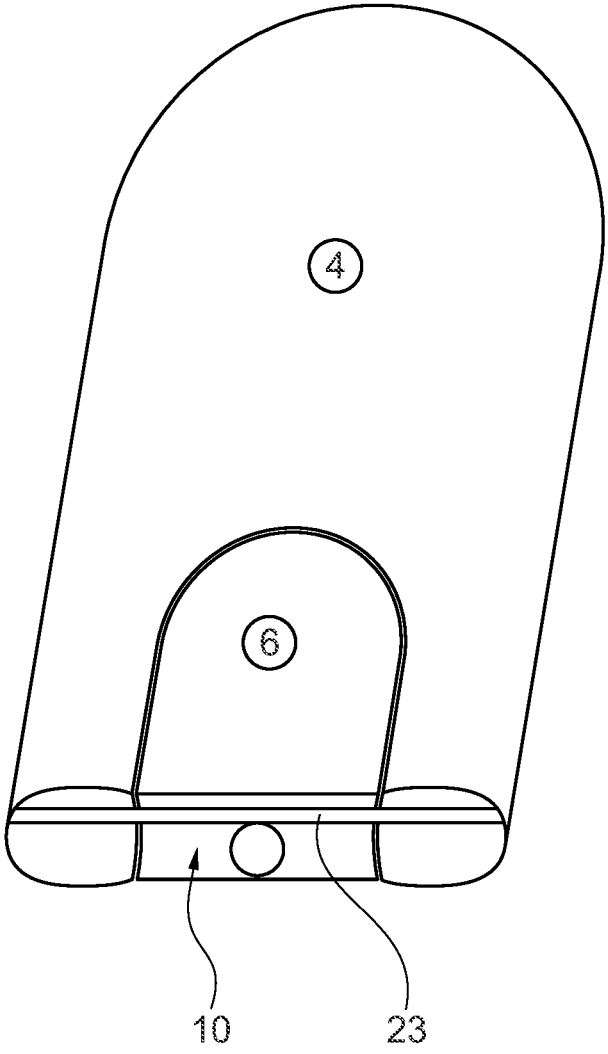
Figure 5B:
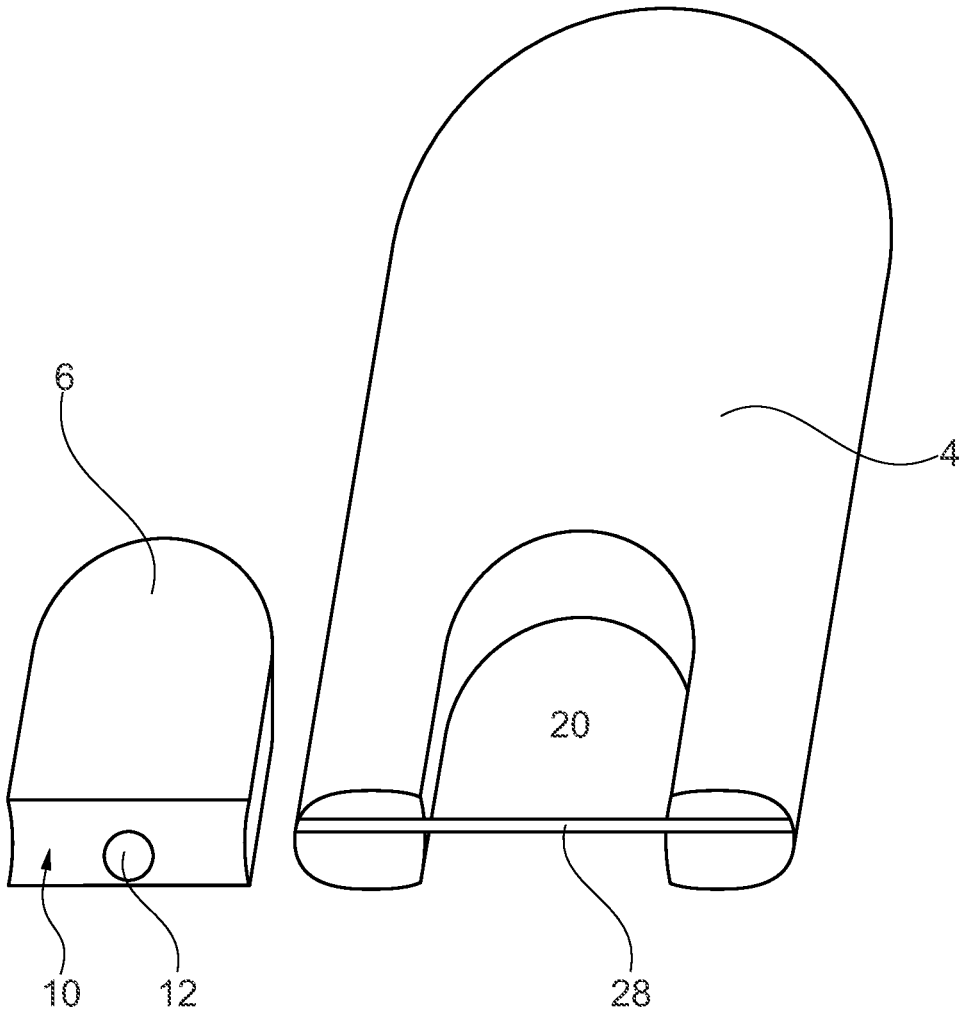
Figure 6:
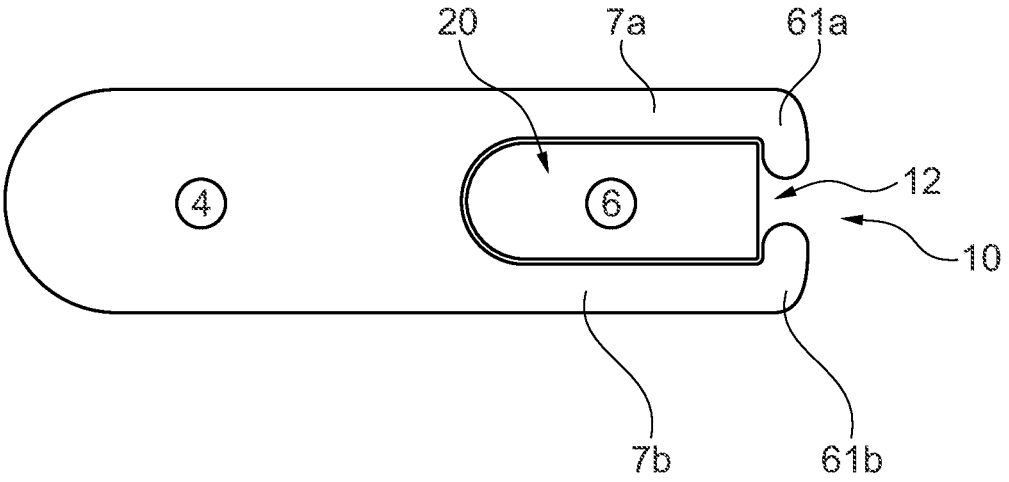

FIG. 4*a* shows a rear view of a third embodiment of a fastening mechanism with a closed fastening belt at the stern end, FIG. 4*b* shows a rear view of the third embodiment of the open belt at the stern end, FIG. 4*c* shows a rear view of the third embodiment of the open belt at the stern end with the drive unit removed, FIG. 5*a* shows a rear view of a fourth embodiment of a fastening mechanism with a belt at the stern end, FIG. 5*b* shows a rear view of the fourth embodiment of a fastening mechanism with a belt at the stern end with the drive unit removed, FIG. 6 shows a rear view of a fifth embodiment of a fastening means at the stern end.

FIG. 1 shows a surfboard 1 according to the invention. In principle, a surfboard is to be understood as a device on which the surfer 1 stands, kneels or sits and which floats on water and ideally has sufficient buoyancy to support the surfer. Where appropriate, the buoyancy can be chosen to be only so great that, together with the forward propulsion of a drive, it is sufficient to support the surfer.

The surfboard 1 comprises a bow 2 and a stern 3. The surfboard 1 is designed substantially in two parts and comprises an inflatable hull component 4 which completely forms the bow region and central region of the surfboard, as well as a drive unit 6 in the stern portion of the surfboard 1 which is laterally flanked, maybe even at least partially enclosed, along its long sides by inflatable arms 7*a*, 7*b* of the hull component 4.

The drive unit 6 comprises a jet drive 8. The jet drive 8 is only illustrated schematically here. The jet drive 8 comprises a water inlet 9 in an underwater surface 5 of the drive unit 6 and a water channel 11 with a water outlet 12 arranged on a rear end face 10 of the stern. The water outlet 12 is designed as a nozzle, which is not pivotable or is rotatable about an axis of rotation arranged vertically with respect to a deck 13. A rotor 14 is arranged in the water channel 11, and this rotor draws water into the water channel 11 and sprays it out of the nozzle contrary to a direction of travel, thereby providing propulsion for the surfer with the surfboard. A rotor 14 is understood here as a propeller and impeller.

In a hull of the surfboard 1 a motor 16 for the rotor 14 is arranged in the drive unit, and drives the rotor 14 by means of a drive train 20, and also arranged there is a controller 21 for the motor 16, by which an output of the motor 16 can be controlled. Thus in particular the speed of the surfboard 1 can be controlled.

The hull component 4 is preferably made from a drop stitch material. The drop stitch material is produced by the drop stitch method, wherein two or more synthetic fabric webs, preferably denier polyester fabric webs are laid one above the other. The two or more synthetic fabric webs are connected to one another by a plurality, i.e. thousands, of polyester threads. In this case the two fabric webs are kept spaced apart from one another, so that the space between the fabric webs which is filled with polyester threads can be filled with compressed air. The polyester threads are sewn to the two fabric webs on both sides, for example with the aid of a drop stitch sewing machine. The two fabric webs which are sewn to one another form the support structure which gives the hull component its mechanical strength in the inflated state.

The two fabric webs which are connected to one another are cut to the required shape. The upper and lower fabric webs are preferably coated with PVC layers, preferably with three layers, and are pressed and glued layer by layer. The faces are glued, overlapping, to the seam strip and are pressed, so that the airtight hull component 4 is produced. The drop stitch method makes it possible to produce the inflatable hull component 4 with outstanding mechanical strength properties, which can withstand not only tensile loads but also compressive loads and shearing loads.

The drop stitch outer skin of the inflatable hull component 4 is airtight and in the inflated state is exceptionally resistant to deformation, so that a surfer can stand and surf on the hull component 4 whilst retaining the external shape of the inflated hull component 4. The inflatable hull component 4 is filled with air under high pressure. The filling can take place by means of an air pump or a compressor. The compressor can be supplied for example with electrical energy by the battery 17 incorporated in the surfboard.

The hull component 4 made from the drop stitch material is preferably low-noise, because the noise generated by the breaking of waves, but also by the drive, is damped by the hull. The hull component 4 is preferably subject to little vibration during operation, because vibrations are reduced by the drop stitch material. Since the hull component 4 is slightly deformable, impacts and waves etc. are advantageously absorbed. Furthermore, by comparison with conventional surfboards it is advantageous that the softer hull causes fewer injuries, for example if the surfboard 1 collides with the surfer in the event of the surfer falling off.

The inflatable hull component 4 has a stern recess 20 which is illustrated for example in FIGS. 2*a* and 2*c*. The recess 20 is substantially U-shaped and has a lateral wall which is convex, i.e. curved into the recess 20.

The drive unit 6 fits into the recess 20 in a positively locking manner. It has a concave wall which is correspondingly shaped towards the interior in a U shape and partially runs around the drive unit 6. The positively locking engagement of the convex wall in the concave wall prevents the drive unit 6 from sliding out upwards and downwards, i.e. in the direction of the deck 13 or in the direction of the underwater surface 5. In terms of height the drive unit 6 is dimensioned such that together with the surfboard 1 it advantageously forms a common deck 13. A deck 13 of the surfboard 1 is formed in one plane with a deck 13 of the drive unit 6. The entire deck 13 only has one narrow U-shaped gap 22 which forms the contact line between the drive unit 6 and the hull component 4.

In cross-section perpendicular to a longitudinal direction L, the two lateral arms 7*a*, 7*b* of the inflatable hull component 4 are curved outwards approximately in a circular shape, at least along the entire periphery.

In order to prevent the drive unit 6 from sliding out towards the stern end during the operation, various fastening means are provided. Although a force acts laterally on the drive unit 6 by the inflation of the hull component 4 and the two arms 7*a*, 7*b*, the force is not usually sufficient in order to produce sufficient friction to anchor the drive unit 6 in the hull component 4 even during operation.

FIGS. 2*a*, 2*b*, 2*c* show a fastening means in the form of two belt sections 23*a*, 23*b*, which are in each case guided inwards from the exterior along the stern end surface 10 of the surfboard 1.

Each of the two belt sections 23*a*, 23*b* is fastened at the side or at the stern end of a respective inflatable arm 7*a*, 7*b*. The fastening means may be a glued connection or a sewn connection or a combination of both or another connection. The belt sections 23*a*, 23*b* have ends 24*a*, 24*b* facing inwards to the recess. The ends 24*a*, 24*b* interact with lever closures 26*a*, 26*b* which are illustrated in a closed state in FIG. 2. The lever closures 26*a*, 26*b* are arranged spaced apart from both sides of the nozzle of the jet drive 8. The lever closures can be configured in particular as toggle lever closures or as ratchets.

In FIGS. 2*a*, 3*a*, 4*a* the lever movements of the lever closures 26*a*, 26*b*, as well as the directions of movement of the ends 24*a*, 24*b* resulting from the movement of the lever closures 26*a*, 27*a* to and fro, are shown by double arrows or by arrows.

FIG. 2*b* shows the lever closures 26*a*, 26*b* in an open state. In this state the lever closures are turned outwards in the direction of the arms 7*a*, 7*b* and free the ends 24*a*, 24*b* of the two belt sections 23*a*, 23*b*. During closure the ends 24*a*, 24*b* are inserted into the lever closures 26*a*, 26*b*, and by the action of force the lever closure is pivoted several times successively upwards and towards the nozzle and progressively tightens the respective belt section 23*a*, 23*b*.

The belt sections 23*a*, 23*b* are not elastic. The elasticity necessary for closure is provided by the elasticity of the incompletely inflated arms 7*a*, 7*b* which, so long as they are not completely inflated, are configured to be significantly elastically variable in diameter.

FIG. 2*c* illustrates the state in which the drive unit 6 is removed from the recess 20 of the inflatable hull component 4. The drive unit 6 can be exchanged or, for transport, can be kept separate from the then deflated hull component 4. FIG. 2*d* shows a back view of a lever mechanism configured as a pair of toggle levers (30*a*, 30*b*), wherein the toggle levers are located on a rear end of the drive unit (6) which allows a user to secure the two lateral arms (7*a*, 7*b*) against the drive unit (6) tightly. In addition, FIG. 2*e* shows a back view of another lever mechanism configured as a ratchet (31*a*, 31*b*), wherein the ratchet is located on a rea end of the drive unit (6). The ratchet can be tensioned to tightly secure the drive unit (6) to the two lateral arms (7*a*, 7*b*) of the surfboard (1). FIG. 2*f* illustrates the lever mechanism configured as the toggle lever 30*b*.

In FIGS. 3*a* to 3*c* the closure according to the first embodiment is illustrated in a converse arrangement. The belt sections 23*a*, 23*b* are preferably permanently fastened, preferably adhered, sewn, riveted, screwed or otherwise fastened to the drive unit 6, they are arranged on both sides spaced apart from the nozzle in a horizontal plane with, again, in each case one of the ends 24*a*, 24*b* which in each case face outwards to the inflatable arms 7*a*, 7*b*. In each case a corresponding belt section 27*a*, 27*b* is fastened to the respective inflatable arms 7*a*, 7*b* by one of the lever closures 26*a*, 26*b* permanently fastened to the respective belt section.

In FIG. 3*a* the two lever closures 26*a*, 26*b* are lowered and the belt sections 23*a*, 23*b* are gripped and thus secure the drive unit 6 in the recess 20 of the inflatable surfboard 1. In FIG. 3*b* the two lever closures 26*a*, 26*b* are opened, and the ends 24*a*, 24*b* of the two belts 23*a*, 23*b* hang down loosely from the stern end of the surfboard 1. Likewise the two lever closures 26*a*, 26*b* hang down loosely on the belt sections 23*a*, 23*b*.

FIG. 3*c* shows the surfboard 1 in a dismantled state corresponding the second embodiment. FIG. 3*d* illustrates the lever mechanism configured as a ratchet having at least one fastening means 23*b*, 24*b*.

FIGS. 4*a* to 4*c* show a third embodiment of the fastening means at the stern end. In this embodiment no part of the fastening means is arranged on the drive unit 6. Instead, a belt is gripped along the stern end surface of the surfboard 1. The belt consists of two belt sections 23, 27, and again an end 24 is formed at one end of one belt section 23 and the lever closure 26 is formed at one end of the corresponding belt section 27. The belt sections 23, 27 are fastened at the sides or on the stern end surface 10 of the two arms 7*a*, 7*b*, for example by a glued connection or a sewn connection. Turning of the lever closure 26 produces sufficient tension to pull the two inflatable arms 7*a*, 7*b* together, so that on the one hand a greater lateral force acts on the drive unit 6 and in addition the drive unit 6 can be prevented from sliding out at the stern end by the transversely extending belt. FIG. 4*b* illustrates the belt in an open state, and in FIG. 4*c* the drive unit 6 is removed from the hull component 4.

FIGS. 5*a* and 5*b* show a fourth embodiment which constitutes a modification of the third embodiment shown in FIGS. 4*a* to 4*b*.

In the fourth embodiment in FIGS. 5*a* and 5*b* a belt 28 is formed in one piece. It is guided from one arm to the other arm 7*a*, 7*b* along the stern end surface 10 thereof. There the two ends of the belt 23 are in turn firmly connected to the side or the stern end surface of the two arms 7*a*, 7*b*, that is to say sewn or glued or both or otherwise fastened. The surfboard 1 is constructed by first spreading out the deflated hull component 4 and optionally incompletely filling it with air, then the drive unit 6 is introduced into the recess 20 of the deflated or partially inflated hull component 4 and only then the belt 28 is laid along the stern end surface 10 of the drive unit 6. In this case, however, the belt 28 is not laid over the nozzle of the jet drive 8. Next the hull component 4 is inflated at high pressure. The length of the belt 28 is chosen to be so short that it is tensioned during inflation of the hull component 4 and an additional pressure can be generated laterally on the drive unit 6. In FIG. 5*b* the drive unit 6 is removed from the hull component 4.

FIG. 6 shows a fifth embodiment, which is likewise the subject of this invention. In this case the stern fastening means is formed as a bend 61*a*, 61*b* in the lateral inflatable arms 7*a*, 7*b*. Each of the lateral inflatable arms 7*a*, 7*b* is hook-shaped or L-shaped and engages behind the drive unit 6 at the stern end, at least in some sections, by means of the bend 61*a*, 61*b*.

In this case the nozzle remains free. A fastening means running completely along the entire stern end surface 10 is not provided. However, it has been shown that the bends 61*a*, 61*b* of the lateral arms 7*a*, 7*b*, with the hooks facing inwards to the surfboard 4, are sufficient when inflated at high pressure to prevent the drive unit 6 from sliding out at the stern end. In cross-section the drive unit 6 and the lateral arms 7*a*, 7*b* and also the embodiments according to FIG. 2 are designed in such a way that the arms 7*a*, 7*b* have a curvature directed towards the recess 20 and the drive unit 6 has an inwardly curved lateral wall, so that here too a substantially positively engaged connection is produced, which completely reliably prevents sliding out in the direction of the deck 13 or towards the underwater surface 5. In order to remove the drive unit 6 from the inflatable hull component 4, first of all at least some air must be released from the hull component 4.

LIST OF REFERENCE NUMERALS

1 surfboard
2 nose
3 tail
4 hull component
5 underwater surface
6 drive unit
7*a* arm
7*b* arm
8 jet drive
9 water inlet
10 end face at the stern end
11 water channel
12 water outlet
13 deck
14 rotor
16 motor
17 battery
20 recess
22 gap
23 belt
23*a* belt
23*b* belt
24*a* end
24*b* end
26*a* lever closure
26*b* lever closure
27 belt section
27*a* belt section
27*b* belt section
28 belt
61*a* bend
61*b* bend
L longitudinal direction

The invention claimed is:

1. An Inflatable surfboard comprising:

an inflatable hull component (4) with two lateral arms (7*a*, 7*b*) which form a receptacle, wherein the inflatable hull component (4) has an upper surface defining a deck (13) of the inflatable surfboard; and a drive unit (6) which forms an outer contour which fits into the receptacle in a positively locking manner, and at least one fastening means (23, 23*a*, 23*b*, 24*a*, 24*b*, 26*a*, 26*b*, 27, 27*a*, 27*b*, 28, 61*a*, 61*b*) at a stern end of the surfboard (1), characterised in that the at least one fastening means (23, 23*a*, 23*b*, 24*a*, 24*b*, 26*a*, 26*b*, 27, 27*a*, 27*b*, 28, 61*a*, 61*b*) is inelastic and is designed as at least one belt (23, 23*a*, 23*b*, 24*a*, 24*b*, 26*a*, 26*b*, 27, 27*a*, 27*b*, 28) which is fastened to the two lateral arms (7*a*, 7*b*) and runs along the drive unit (6) at the stern end and is tensioned by means of a lever mechanism (24*a*, 26*a*, 24*b*, 26*b*) and the lever mechanism (24*a*, 26*a*, 24*b*, 26*b*) is configured as a toggle lever (30*a*, 30*b*) or a ratchet (31*a*, 31*b*) and in that the deck (13) has a single narrow U-shaped gap (22) with the hull component which forms a contact line between the drive unit (6) and the hull component (4).

2. Inflatable surfboard according to claim 1, characterised in that the at least one fastening means comprises two belt sections (23*a*, 23*b*, 27*a*, 27*b*) which in each case run from one of the two arms (7*a*, 7*b*) to the drive unit (6).

3. Inflatable surfboard according to claim 1, characterised in that the at least one fastening means (23, 23*a*, 23*b*, 24*a*, 24*b*, 26*a*, 26*b*, 27, 27*a*, 27*b*, 28, 61*a*, 61*b*) comprises two fastening means (23, 23*a*, 23*b*, 24*a*, 24*b*, 26*a*, 26*b*, 27, 27*a*, 27*b*) which are provided and in each case designed as a belt, which in each case runs from one side of the arms (7*a*, 7*b*) or runs from a stern end of the arms (7*a*, 7*b*) to the stern end of the drive unit (6) and releasably connects the stern end of the arms (7*a*, 7*b*) and the stern end of the drive unit (6) to one another.

4. Inflatable surfboard according to claim 1, characterised in that the at least one belt comprises a belt section (23, 23*a*, 24*a*, 26*a*, 27, 27*a*) and a corresponding belt section (23*b*, 24*b*, 26*b*, 27*b*), wherein the belt section is fastened by means of the ratchet or the toggle lever to a counterpart of the corresponding belt section (23*b*, 24*b*, 26*b*, 27*b*).

* * * * *